US005421617A

United States Patent [19]

Goldring

[11] Patent Number: 5,421,617

[45] Date of Patent: Jun. 6, 1995

[54] ROTARY DEVICE FOR STORING AND ACCESSING CORRELATED INFORMATION

[75] Inventor: Harold B. Goldring, Woodcliff Lake, N.J.

[73] Assignee: Goldring Display Group, Inc., Paramus, N.J.

[21] Appl. No.: 25,782

[22] Filed: Mar. 3, 1993

[51] Int. Cl.[6] ..... B42D 15/00

[52] U.S. Cl. ..... 283/65

[58] Field of Search ..... 283/65, 115, 117; 235/79, 79.5

[56] References Cited

U.S. PATENT DOCUMENTS 1,209,878 12/1916 Oliver ..... 283/65

2,293,175 8/1942 Rühl et al. ..... 235/79.5

4,369,358 1/1983 Adams ..... 283/65 X

*Primary Examiner*—Willmon Fridie

*Attorney, Agent, or Firm*—Anthony F. Cuoco

[57] ABSTRACT

A cylindrical drum has correlated information stored thereon in circumferentially extending longitudinally spaced rows. The drum is rotatably disposed within an open cylinder and the cylinder has windows longitudinally spaced therealong so as to correspond to the longitudinal spacing of the rows. The drum is attached to knobs which are integral with end caps for closing the cylinder, and when the drum is rotated via the knobs the information on the drum is accessed and is visible through the windows in the cylinder.

5 Claims, 3 Drawing Sheets

ROTARY DEVICE FOR STORING AND ACCESSING CORRELATED INFORMATION

BACKGROUND OF THE INVENTION

This invention relates to a device for providing ready access to a file of stored correlated information and, more particularly, to a device of the type described which eliminates the need for computer equipment and associated software for the purpose described.

It is often necessary to access and display stored correlated information such as, for example, information which matches questions and answers. While a computer may be used for the purpose described, computer equipment is costly and not readily available to those who may need the information, and requires training as to its use. The present invention is simple to use so as to require virtually no training and can be made readily available to a variety of users.

SUMMARY OF THE INVENTION

This invention contemplates a rotary device for storing and accessing correlated information including a cylindrical drum having the information stored thereon so as to extend longitudinally across the drum and circumferentially therearound. The drum is disposed in an open cylinder. The cylinder has a plurality of longitudinally spaced windows. A pair of end caps for closing the cylinder have integral knobs external thereto and internally disposed circumferential grooves. The drum disposed within the cylinder is attached to the grooves. The grooves are wide enough so that the cylinder ends fit loosely therein, whereby the drum is freely rotatable in the cylinder. The arrangement is such that when the knobs are turned to rotate the drum, the stored correlated information is accessed and is displayed through the windows in the cylinder. Optionally, an apron may extend angularly outwardly from the cylinder along the length thereof, and brackets are secured to the cylinder for mounting the device to a supporting structure such as a shelf or the like, as may be desired.

DETAILED DESCRIPTION OF THE INVENTION

Figure 1:
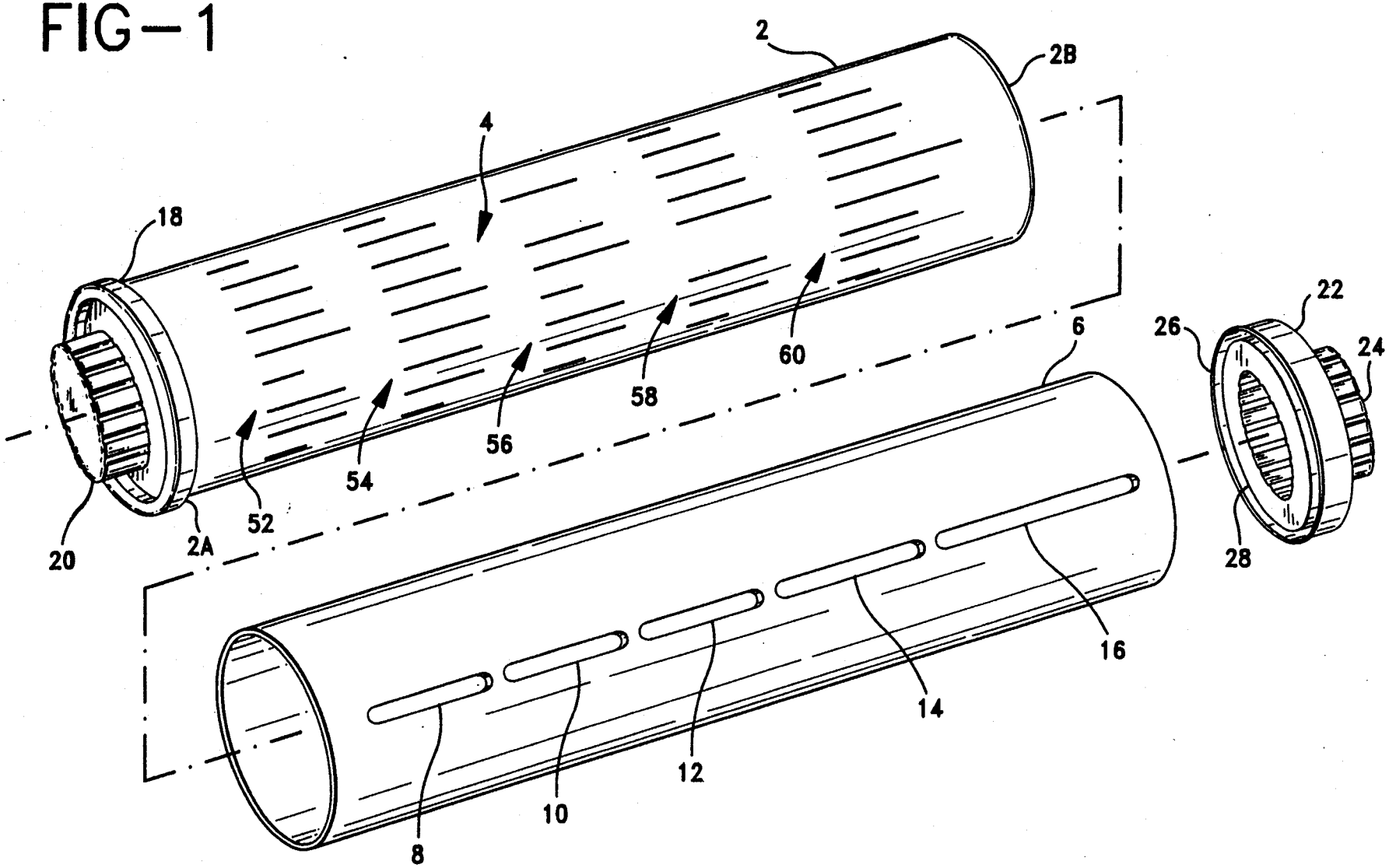
FIG. 1 is an exploded view illustrating the components of the invention and the general arrangement thereof.

With reference to FIG. 1, a drum is designated by the numeral 2 and stores correlated information. The stored information extends longitudinally therealong and circumferentially therearound. The information is illustrated symbolically and is designated generally by the numeral 4.

Drum 2 is rotatably disposed within an open cylinder 6. Cylinder 6 has plurality of windows shown as five in number and designated by the numerals 8, 10, 12, 14 and 16, and which windows extend longitudinally along the cylinder.

Drum 2 is secured at one end 2A thereof to a cylinder end cap 18 having an integral external knob 20, and is secured at an opposite end 2B to a cylinder end cap 22 likewise having an integral external knob 24. In this regard, particular reference is made to end cap 22 which is shown in detail in FIG. 1 and which will be hereinafter described, with end cap 18 being structurally the same.

End cap 22 has an internal groove 26 extending circumferentially therearound. Opposite end 2B of drum 2 fits over the inner edge 28 of groove 26 and is secured thereto as by a suitable cement or the like. Groove 26 is wide enough so that when drum 2 is disposed within cylinder 6 the outer circumference of the cylinder fits within the groove with a circumferential clearance extending therearound. End cap 18 is likewise arranged with the one end 2A of drum 2 and with the corresponding end of cylinder 6. With the arrangement described otherwise open cylinder 6 is closed and drum 2 so disposed within cylinder 6 is freely rotatable within the cylinder via knobs 20 and 24 as by a user of the device, as will now be appreciated.

Figure 2:
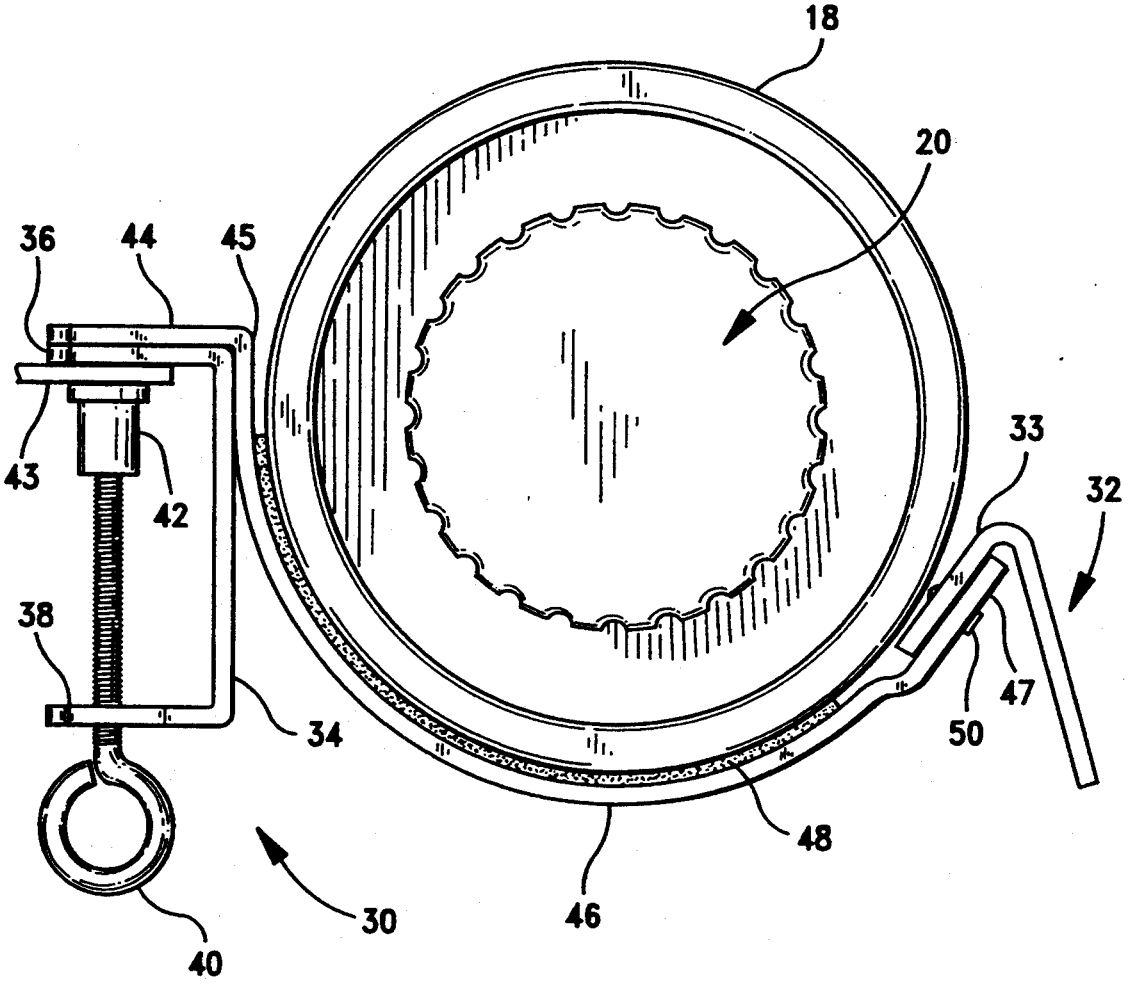
FIG. 2 is an end elevational view illustrating the invention.

With reference to FIG. 2, optional features of the invention are shown including a mounting arrangement including a pair of mounting clamps such as designated generally by the numeral 30 and a rigid apron designated generally by the numeral 32. Mounting clamp 30 includes a bracket 34 having a pair of outwardly extending parallel arms 36 and 38. A bolt 40 is in threaded engagement at one end thereof with one of the arms such as 38 so as to be threadingly adjustable toward arm 36. Bolt 40 carries a mounting pad 42 on the opposite end thereof. Bolt 40 is threadingly adjusted so that pad 42 engages a shelf or the like 43 to which it may be desired to mount the device of the invention.

Bracket arm 36 is secured by suitable mechanical means (not otherwise shown) to a like extending arm 44 at a rearward end 45 of a generally arcuate shaped clip 46. Arcuate shaped clip 46, is secured near one end of cylinder 6 (FIG. 1) by a suitable adhesive pad or the like 48. Arcuate clip 46 extends partially around the lower circumference of cylinder 6 with apron 32 having an angled portion 33 thereof attached to an opposite or forward end 47 of the arcuate member as by suitable mechanical means 50, whereby apron 32 extends angularly downwardly from cylinder 6.

A like configuration including a clamp such as 30, an arcuate clip such as 46 and a mounting pad such as 48 is arranged near the opposite end of cylinder 6, with the aforegoing description applying thereto. Apron 32 extends longitudinally across the cylinder as particularly illustrated in FIG. 3.

With reference again to FIG. 1, correlated information is stored on drum 2 as aforenoted. The information is disposed on the drum in a plurality of circumferentially extending rows shown as five in number and designated by the numerals 52, 54, 56, 58 and 60. The circumferentially extending rows are longitudinally spaced along drum 2. The longitudinal spacing of windows 8, 10, 12, 14 and 16 in cylinder 6 corresponds to the longitudinal spacing of circumferential rows 52, 54, 56, 58 and 60, respectively. Thus, when drum 2 secured to end caps 18 and 22 as aforenoted and is rotated via knobs 20 and 24 integral with end caps 18 and 22, respectively. The information in the circumferential rows on drum 2 is accessed and is visible through the corresponding windows in cylinder 6.

While the invention as heretofore described may be used for a variety of purposes, its use will be illustrated, by way of illustration but not by way of limitation, in relation to the care and feeding of small fish such as kept in home aquariums. Thus, the information stored in circumferential row 52 may list the particular fish alphabetically by name. The information stored in circumferential row 54 may list primary foods for the fish, either generically or by trade name. Likewise, the information stored in circumferential row 56 may list particular treat foods for the fish, also generically or by trade name. The information stored in circumferential row 58 may indicate care hints for the fish and the information stored in circumferential row 60 may indicate compatibility characteristics as may be desireable for properly maintaining the fish either alone or together with other fish. Thus, when drum 2 is rotated so that a particular named fish is accessed and is visible through window 8 in cylinder 6, correlated information for that particular fish as stored in circumferential rows 54, 56, 58 and 60 is accessed and is visible through windows 10, 12, 14 and 16, respectively.

Figure 3:
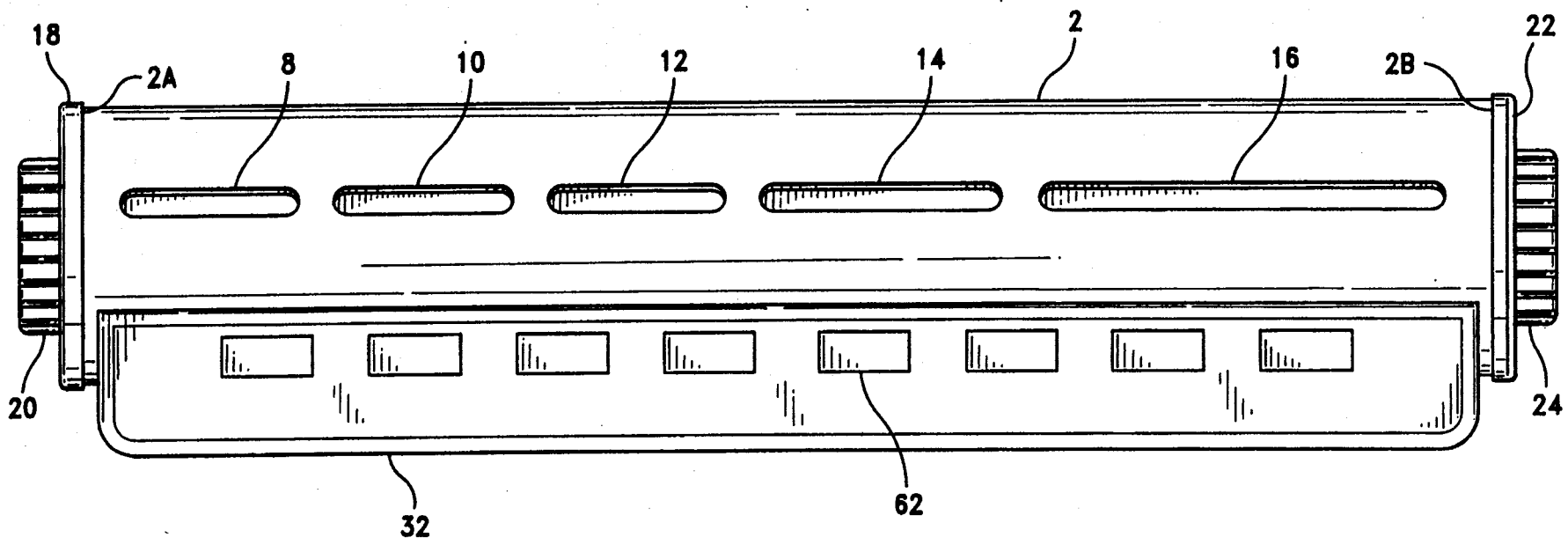
FIG. 3 is a front elevational view illustrating the invention.

With particular reference to FIG. 3, apron 32 may include a plurality of panels such as designated by the numeral 62. Panels 62 may carry visual or textual representations relating to fish food, fish care, compatibility, etc., and may also carry advertising information for particular suppliers of fish food, as the case may be.

There has thus been described a device for storing correlated information and for providing easy access to said information without the need for complex computer equipment and associated software. The device is easy to use and the information is readily accessible as is desireable.

With the above description of the invention in mind, reference is made to the claims appended hereto for a definition of the scope of the invention.

What is claimed is:

1. A rotary device for storing and accessing correlated information, comprising:

a cylindrical drum having the correlated information stored thereon in a plurality of circumferentially extending, longitudinally spaced rows;

an open cylinder having a plurality of longitudinally spaced windows, the longitudinal spacing of the windows corresponding to the longitudinal spacing of the rows;

the drum disposed within the cylinder; and means arranged with the drum and the cylinder for closing the cylinder and for rotating said drum within said cylinder, whereby the correlated information stored in the circumferential rows on the drum is accessed and is displayed through the longitudinally spaced windows in the cylinder, said means including a first end cap for closing one end of the open cylinder, a second end cap for closing an end of the open cylinder opposite the one end, each of said first and second end caps having an external knob and an internal circumferentially extending groove, the drum having one end which fits within the groove of the first end cap and is secured therein and an end opposite the one end which fits within the groove of the second end cap and is secured therein, the one end of the open cylinder fitting within the groove in the first end cap and the opposite end of the open cylinder fitting within the groove of the second end cap, and the drum being rotatable within the cylinder via the external knobs on the first and second end caps, whereby the stored information is accessed and is displayed through the longitudinally spaced windows.

2. A rotary device for storing and accessing correlated information, comprising:

a cylindrical drum having the correlated information stored thereon in a plurality of circumferentially extending, longitudinally spaced rows;

an open cylinder having a plurality of longitudinally spaced windows, the longitudinal spacing of the windows corresponding to the longitudinal spacing of the rows;

a first arcuate member extending partially around the lower circumference of the cylinder near the one end thereof and secured to said cylinder;

a second arcuate member extending partially around the lower circumference of the cylinder near the opposite end thereof and secured to said cylinder;

each of said first and second arcuate members having a rearward end and a forward end;

first and second clamping means secured to the rearward ends of the first and second arcuate members, respectively, for securing the device to a supporting member;

the drum disposed within the cylinder; and means arranged with the drum and the cylinder for closing the cylinder and for rotating said drum within said cylinder, whereby the correlated information stored in the circumferential rows on the drum is accessed and is displayed through the longitudinally spaced windows in the cylinder.

3. A device as described by claim 1, including:

a first arcuate member extending partially around the lower circumference of the cylinder near the one end thereof and secured to said cylinder;

a second arcuate member extending partially around the lower circumference of the cylinder near the opposite end thereof and secured to said cylinder;

each of said first and second arcuate members having a rearward end and a forward end; and first and second clamping means secured to the rearward ends of the first and second arcuate members, respectively, for securing the device to a supporting member.

4. A device as described by claim 3, including:

an apron secured to the forward ends of the first and second arcuate members so as to extend angularly outwardly from the cylinder along the length thereof.

5. A device as described by claim 3, including:

an apron secured to the forward ends of the first and second arcuate members so as to extend angularly outwardly from the cylinder along the length thereof.

* * * * *